US006630775B1

(12) United States Patent
Shin et al.

(10) Patent No.: US 6,630,775 B1
(45) Date of Patent: Oct. 7, 2003

(54) TENSION MASK FRAME ASSEMBLY FOR COLOR CATHODE RAY TUBE

(75) Inventors: Soon-cheol Shin, Suwon (KR); Chan-yong Kim, Incheon Metropolitan (KR); Sang-shin Choi, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 218 days.

(21) Appl. No.: 09/712,952

(22) Filed: Nov. 16, 2000

(30) Foreign Application Priority Data

Nov. 16, 1999 (KR) ..... 1999-50943

(51) Int. Cl.[7] ..... H01J 29/80
(52) U.S. Cl. ..... 313/407; 313/402; 313/403
(58) Field of Search ..... 313/402, 403, 313/407, 408

(56) References Cited

U.S. PATENT DOCUMENTS

| | | | | |
|---|---|---|---|---|
| 3,686,525 A | * | 8/1972 | Naruse et al. | 313/92 B |
| 4,127,791 A | * | 11/1978 | van Lent | 313/403 |
| 4,296,189 A | * | 10/1981 | Kuzminski | 430/5 |
| 4,926,089 A | * | 5/1990 | Moore | 313/403 |
| 4,942,332 A | | 7/1990 | Adler et al. | 313/402 |
| 4,942,333 A | | 7/1990 | Knox | 313/402 |
| 4,973,283 A | | 11/1990 | Adler et al. | 445/30 |
| 5,072,150 A | | 12/1991 | Lee | 313/405 |
| 5,126,624 A | | 6/1992 | Ji | 313/402 |
| 5,210,459 A | | 5/1993 | Lee | 313/406 |
| 5,488,263 A | | 1/1996 | Takemura et al. | 313/402 |
| 5,523,647 A | | 6/1996 | Kawamura et al. | 313/407 |
| 5,534,746 A | | 7/1996 | Marks et al. | 313/408 |
| 5,917,273 A | * | 6/1999 | Watanabe et al. | 313/402 |
| 6,057,640 A | | 5/2000 | Aibara | 313/403 |
| 6,072,270 A | | 6/2000 | Hu et al. | 313/402 |
| 6,097,142 A | | 8/2000 | Ko | 313/402 |
| 6,157,120 A | * | 12/2000 | Tseng et al. | 313/402 |
| 6,388,370 B1 | * | 5/2002 | Ohmae | 313/403 |
| 6,486,596 B1 | * | 11/2002 | Inoue et al. | 313/402 |

FOREIGN PATENT DOCUMENTS

KR 1999-073660 11/1998

OTHER PUBLICATIONS

Korean Industrial Property Office Action, Ser. No. 10–1999–0050943 issued Sep. 27, 2002 entitled Notice to Submit Response.

English language translation of Notice to Submit Response issued on Sep. 27, 2002 in Korean Priority Application No. 10–1999–0050943.

* cited by examiner

*Primary Examiner*—David V. Bruce
*Assistant Examiner*—Jurie Yun
(74) *Attorney, Agent, or Firm*—Robert E. Bushnell, Esq.

(57) ABSTRACT

A tension mask frame assembly for a color cathode ray tube, including: a tension mask having a plurality of strips on which slots are formed being separated a predetermined distance from each other on a thin plate, real bridges for partitioning slots at a predetermined pitch interval by connecting adjacent ones of a plurality of strips to each other; and a frame which supports the corresponding edges of the tension mask, whereby a tensile force is applied to the tension mask, and the vertical pitch of the real bridges becomes smaller in a direction from the center portion of the tension mask to the peripheral portion of the tension mask.

28 Claims, 6 Drawing Sheets

TENSION MASK FRAME ASSEMBLY FOR COLOR CATHODE RAY TUBE

CLAIM OF PRIORITY

This application makes reference to, incorporates the same herein, and claims all benefits accruing under 35 U.S.C. §119 from an application entitled TENSION MASK FRAME ASSEMBLY FOR COLOR CRT earlier filed in the Korean Industrial Property Office on the Nov. 16, 1999, and there duly assigned Ser. No. 99-50943.

BACKGROUND OF THE INVENTION

1. Field of the Invention

The present invention relates to color cathode ray tubes, and more particularly, to a tension mask frame assembly for a color cathode ray tube, having an improved tension mask which is fixed to a frame.

2. Description of the Related Art

In color cathode ray tubes (color CRTs), an electron beam emitted from an electron gun lands on a fluorescent film through electron beam passing holes in a shadow mask and excites the fluorescent film to form an image.

The screen surface of conventional color CRTs which form an image as described above is designed so as to have a predetermined curvature in consideration of the deflection trajectory of an electron beam which is emitted from an electron gun and deflected by a deflection yoke. The tension mask is designed so as to have a curvature corresponding to the curvature of the screen surface.

A shadow mask, which is manufactured so as to have a curvature similar to the curvature of the inner surface of the screen surface, is heated by an electron beam, that is, by a thermoelectron, emitted from the electron gun, which causes a doming phenomenon in which a shadow mask is swollen toward a panel. The doming phenomenon prevents the electron beam from accurately landing on the fluorescent film. As described above, the screen surface is designed to have a predetermined curvature, such that the view angle is narrowed and the fluorescent film is excited at the periphery of the screen surface, thus distorting the formed image.

In order to solve these problems, a color cathode ray tube (CRT) having a flat-surface screen has been developed. In such a color CRT, a tension mask, in a state where a tensile force is applied thereto, is fixed to the inner surface of a panel so as to be separated a predetermined distance from a fluorescent film formed on the inner surface of the panel. In this state, the panel is sealed with a funnel on which an electron gun and a deflection yoke are mounted.

Examples of a tension mask installed in a color CRT are respectively disclosed in U.S. Pat. No. 5,488,263, U.S. Pat. No. 4,973,283, U.S. Pat. No. 4,942,332, U.S. Pat. No. 4,926,089 and U.S. Pat. No. 6,097,142, for example.

An example of a tension mask, illustrative and exemplary of those disclosed in the aforementioned patents, is shown in FIG. 1. As shown in FIG. 1, the tension mask has a plurality of strips 21 formed in parallel, and a slot 23 is formed by strips 21 and tie bars 22 having a vertical pitch PV, which connect the strips 21 to each other. Here, the vertical pitch PV of the tie bar and the horizontal pitch PH of slots are equal at the center portion of the tension mask to those at the peripheral portion of the tension mask. The slots have a plurality of auxiliary tie bars 24 which extend from a strip 21 on one side to an opposite strip side.

However, in a tension mask having the auxiliary tie bars 24 as described above with respect to FIG. 1, as the vertical pitch PV of the tie bar 22 is relatively increased, a ligament ratio is correspondingly lowered. That is, referring to FIG. 2, the ligament ratio obtained by dividing the width W of the tie bar 22 by one of two equal parts PV into which the vertical pitch of a slot is divided. Thus, as the vertical pitch of a slot increases, the ligament ratio is relatively lowered.

As described above, when the ligament ratio is lowered, a supporting force between strips 21 is typically deteriorated, so that a tension mask can be easily plastic-deformed by an impact applied from an external source, such as an impact applied in a vertical direction. That is, referring to FIGS. 1 and 2, a vibration, which is transmitted from the center to the periphery of the tension mask 20 when an impact is applied in the vertical direction of the tension mask 20, can cause a sudden increase in stiffness at a relatively-wide end strip area, which is the horizontal end of the tension mask, so that the edge of the tension mask is plastic-deformed. This phenomenon occurs since an impact applied to the center portion is transmitted to the horizontal edge without reduction due to the fact that the vertical pitch of the tension mask 20 is the same at the center portion and the peripheral portion.

U.S. Pat. No. 4,926,089 to Moore entitled Tied Slit Foil Shadow Mask With False Ties, disclosesa front assembly for a color cathode ray tube that includes a glass faceplate that has on its inner surface a centrally disposed phosphor screen. A metal foil shadow mask is mounted in tension on a mask support structure located on opposed sides of the screen. The mask includes a series of parallel strips separated by slits, the strips being coupled by widely spaced ties. The mask has between the strips one or more false ties extending partially between but not interconnecting adjacent strips. The screen may also have spaced ties interconnecting the grille lines with a periodicity much smaller than that of the mask ties and below an observer's resolution threshold at normal viewing distances.

U.S. Pat. No. 4,942,332 to Adler et al. entitled Tied Slit Mask For Color Cathode Ray Tubes disclose a slit-type foil tension mask and associated front assembly for a color cathode ray tube that includes a series of parallel strips separated by slits. The strips are loosely coupled by widely spaced ties, the wide tie spacing being such as to produce a strip coupling which promotes handleability of the mask during mask and tube fabrication and facilitates damping of strip vibration when mounted in a tube. Also, in FIG. 11 therein it is disclosed that the vertical position, or pitch, of the ties is not constant but is randomly varied from tie to tie to suppress tie visibility. Also, in FIG. 12 therein it is disclosed that false ties are placed along the slit edges at regular intervals between the real ties and with a pitch less than that of the real ties.

U.S. Pat. No. 4,942,333 to Knox entitled Shadow Mask With Border Pattern discloses a shadow mask adapted for tensioned mounting in a flat faced color CRT having a pattern of slits in the border regions of the mask disclosed to provide uniform distribution of tensile stresses across the mask when mounted in the CRT.

U.S. Pat. No. 4,973,283 to Adler et al. entitled Method Of Manufacturing A Tied Slit Mask CRT disclose a slit-type foil tension mask and associated front assembly for a color cathode ray tube including parallel strips separated by slits. The strips are loosely coupled by widely spaced ties, the wide tie spacing being such as to produce a strip coupling which promotes handleability of the mask during mask and tube fabrication and facilitates damping of strip vibration when mounted in a tube.

U.S. Pat. No. 5,072,150 to Lee entitled Shadow Mask Assembly for Color Picture Tube disclose a shadow mask frame for a color picture tube that has side walls which are cut out to form cut-out sections, leaving only a plurality of bridge portions. A separate supporting means for the frame is provided in direct contact with the shadow mask.

U.S. Pat. No. 5,126,624 to Ji entitled Color Cathode Ray Tube Having Improved Spring Type Contactor discloses a color cathode ray tube having a spring type contactor. The spring type contactor effects electrical connection between a frame and a conductive coating deposited on the inner surface of the funnel, and comprises an '.OMEGA.' shaped fitting portion for being inserted into holes respectively perforated on the shield and the frame to be locked therein, a pair of legs abutting the edge of the hole of the shield, and a 'C' shaped contact portion extended from one of the legs to contact with the conductive coating on the inner surface of the funnel.

U.S. Pat. No. 5,210,459 to Lee entitled Shadow Mask Structure Of A Color Cathode Ray Tube discloses a cathode ray tube with a shadow mask, the shadow mask structure being suspended and fixed behind the panel of the cathode ray tube. Plate springs for connecting the shadow mask structure and the panel are placed to apply pulling forces at either the sides or the corners of the shadow mask frame, so as to hold the shadow mask to the skirt so as not to deform the shadow mask.

U.S. Pat. No. 5,488,263 to Takemura et al. entitled Color Selecting Electrode For Cathode-Ray Tube disclose a color selecting electrode for use in cathode-ray tube which includes a frame having a pair of opposed first supports and a pair of opposed second supports extending in a direction such as to cross the pair of first supports, and grid elements disposed on the pair of first supports at a fixed pitch and stretchedly bridging the pair of first supports.

U.S. Pat. No. 5,523,647 to Kawamura et al. entitled Color Cathode Ray Tube Having Improved Slot Type Shadow Mask disclose a color cathode ray tube having a slot type shadow mask. The shadow mask assembly is suspended inside the panel, and is disclosed as including a mask frame, and the shadow mask held on the mask frame, the shadow mask having a large number of grilles and bridges disposed at an interval for connecting adjacent grilles, the grilles and the bridges having sections which are concave in opposite directions, respectively.

U.S. Pat. No. 5,534,746 to Marks et al. entitled Color Picture Tube Having Shadow Mask With Improved Aperture Spacing disclose a color picture tube that includes a shadow mask and a dot screen, wherein the mask is rectangular and has two horizontal long sides and two vertical short sides. The long sides parallel a central major axis of the mask and the short sides parallel a central minor axis of the mask. The mask includes an array of apertures arranged in vertical columns and horizontal rows. Apertures in one row are disclosed as being in different columns than are the apertures in adjacent rows. The vertical spacing between apertures in the same column is the vertical pitch of the apertures and horizontal spacing between apertures in the same row is the horizontal pitch of the apertures. It is disclosed the horizontal pitch of the apertures increases from the minor axis to the short side of the mask and decreases from the major axis to the long sides of the mask. Also, along the major axis, the vertical pitch of the mask is disclosed as decreasing from the center to the short sides of the mask and, adjacent the long sides of the mask, it is disclosed as increasing from the minor axis to the corners of the mask.

U.S. Pat. No. 6,057,640 to Aibara entitled Shadow Mask For Color Cathode Ray Tube With Slots Sized to Improve Mechanical Strength And Brightness discloses a shadow mask for a cathode ray tube, including a plate having a first surface and a second surface. The plate is formed with at least one line of slots between which bridge portions are formed, each slot being spaced away from adjacent slots by a predetermined pitch. The bridge portions are defined by a first length at the first surface of the plate and a second length at the second surface of the plate, the first and second lengths being determined so that a factor is in the range of 5% to 15%, the factor being defined as a ratio of the smaller of the first and second lengths, to the predetermined pitch.

U.S. Pat. No. 6,072,270 to Hu et al. entitled Shadow Mask for color CRT disclose a shadow mask employed as a color selection electrode in a multi-electron beam color cathode ray tube (CRT), the surface area of the mask being reduced by increasing the length of the individual elongated beam passing apertures, or slots, while reducing the ratio of the width of the bridge portion of the mask between adjacent apertures to the length of the aperture.

U.S. Pat. No. 6,097,142 to Ko entitled Shadow Mask Having An Effective Face Area And Ineffective Face Area discloses a shadow mask including an effective face area constituting a central portion of the shadow mask. The effective face area has electron beam apertures, which electrons pass through. A secondary ineffective face area surrounds the effective face area and also has apertures. A frame attaching border further surrounds the secondary ineffective face area, and a primary ineffective face area at least partially surrounds the frame attaching border. Corners of the shadow are adjacent the primary ineffective face area and do not have apertures. It is disclosed portions of the primary and/or secondary ineffective areas are treated with tie bar grading and/or have round corners.

SUMMARY OF THE INVENTION

To promote resolving the above problem, an objective, among other objectives, of the present invention is to provide a tension mask frame assembly for a color cathode ray tube, by which a tension mask is prevented from being plastic-deformed by a tensile force applied to the tension mask or by a strong impact applied from an external source.

To achieve the above objective and other objectives of the present invention, the present invention provides a tension mask frame assembly for a color cathode ray tube including: a tension mask having a plurality of strips on which slots are formed being separated a predetermined distance from each other on a thin plate, and real bridges for partitioning slots at a predetermined pitch interval by connecting adjacent ones of the plurality of strips to each other; and a frame which supports the corresponding edges of the tension mask, whereby a tensile force is applied to the tension mask, and the vertical pitch of the real bridges becomes smaller in a direction from the center portion of the tension mask to the peripheral portion of the tension mask.

Also, in the present invention, the tension mask desirably includes a dummy bridge that extends from a strip on at least one side of corresponding slot to a strip on the opposite side of the corresponding slot and being formed on a slot partitioned by a corresponding one of the real bridges.

Also, to achieve the above objective and other objectives of the present invention, the present invention provides a tension mask frame assembly for a color cathode ray tube including: a tension mask having a plurality of strips on which slots are formed being separated a predetermined distance from each other on a thin plate, and real bridges for partitioning slots at a predetermined pitch interval by connecting adjacent ones of the plurality of strips to each other;

and a frame which supports the corresponding edges of the tension mask, whereby a tensile force is applied to the tension mask, and the vertical pitch of the real bridges becomes smaller at both shorter sides of the tension mask than at the center portion of the tension mask.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
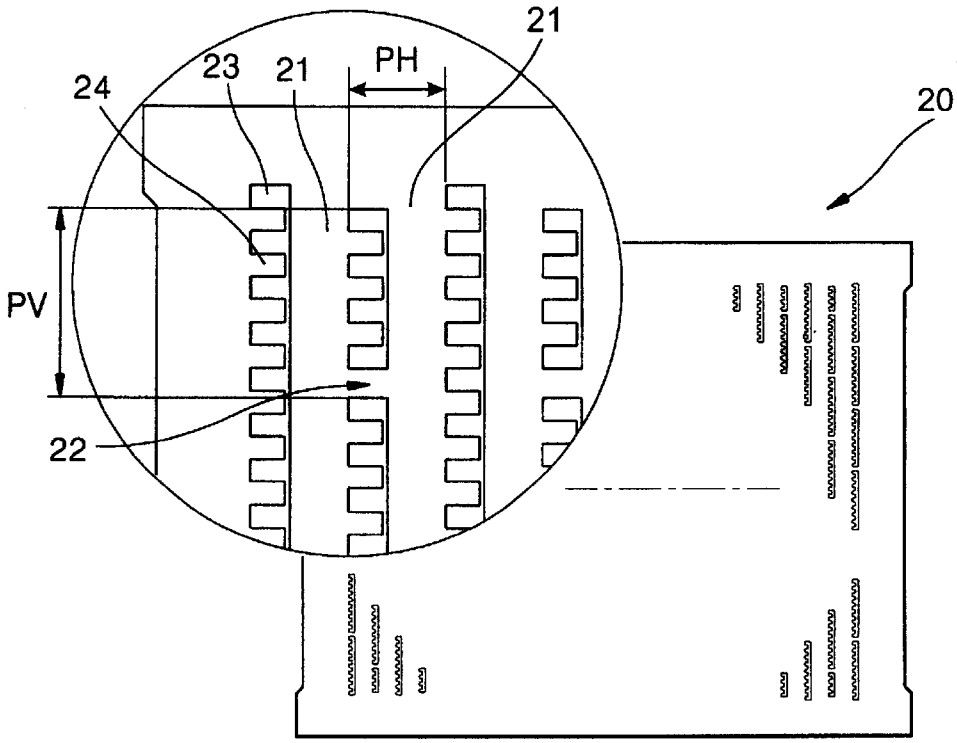
FIG. 1 (PRIOR ART)
FIG. 1 is a plan view of a conventional tension mask of a color cathode ray tube.
Figure 2:
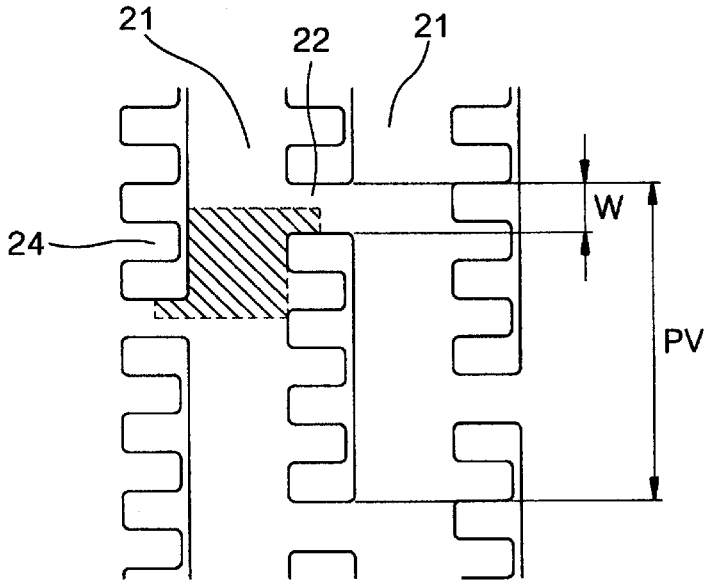
FIG. 2 (PRIOR ART)
FIG. 2 is a magnified view of part of the tension mask shown in FIG. 1.
Figure 3:
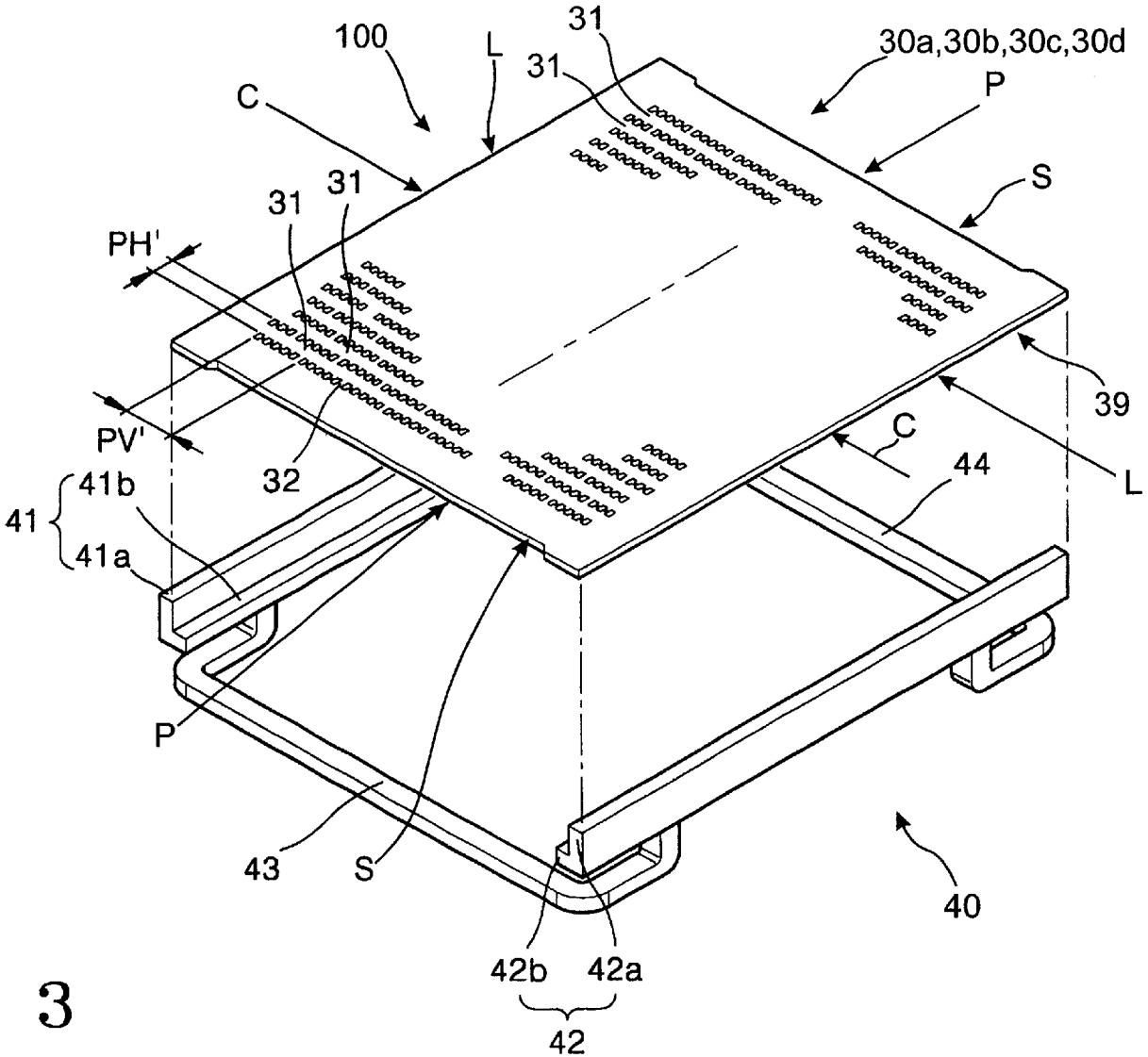
FIG. 3 is an exploded perspective view of a tension mask frame assembly for a color cathode ray tube according to an embodiment of the present invention.
Figure 4:
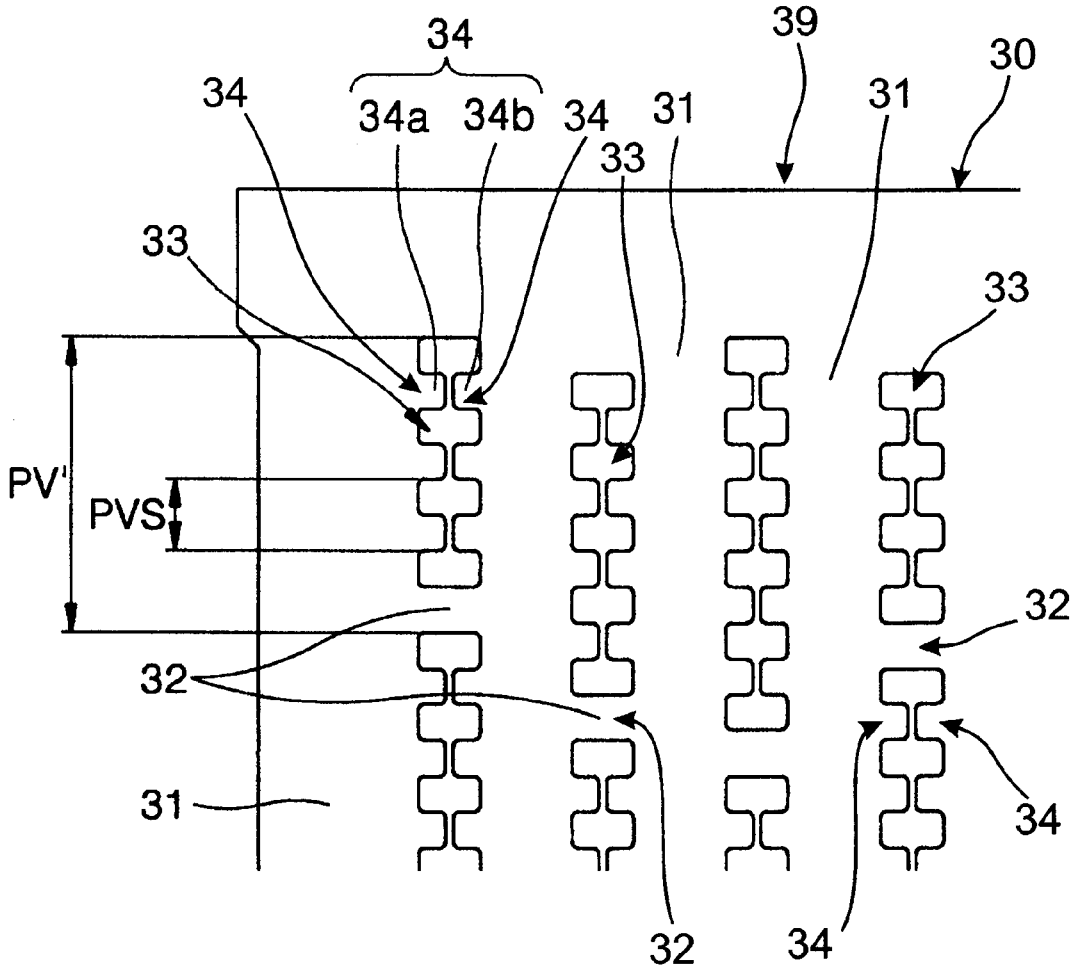
FIG. 4 is a plan view of a tension mask shown in FIG. 3.

Referring to FIGS. 3 and 4, a tension mask frame assembly 100 for a color cathode ray tube according to an embodiment of the present invention includes a tension mask 30 which can distinguish the colors of an electron beam, and a frame 40 for supporting the tension mask 30 so that the tension mask 30 has a predetermined tensile force. The tension mask 30 has a plurality of strips 31 formed on a thin plate 39 so as to be isolated a predetermined distance from each other, and a plurality of 33 slots formed by connecting the adjacent strips 31 to a real bridge 32 having a predetermined vertical pitch PV'. The strips 31 and the real bridges 32 are formed by etching the thin plate 39, for example. The predetermined vertical pitch PV' of the real bridges 32, which defines the slots 33 by connecting adjacent strips 31 of the tension mask 30 to each other, becomes smaller in the direction from the center portion C to the peripheral portion P of the tension mask 30. Thus, the number of real bridges 32 gradually increases in the direction from the center portion C to the peripheral portion P of the tension mask 30.

Figure 5:
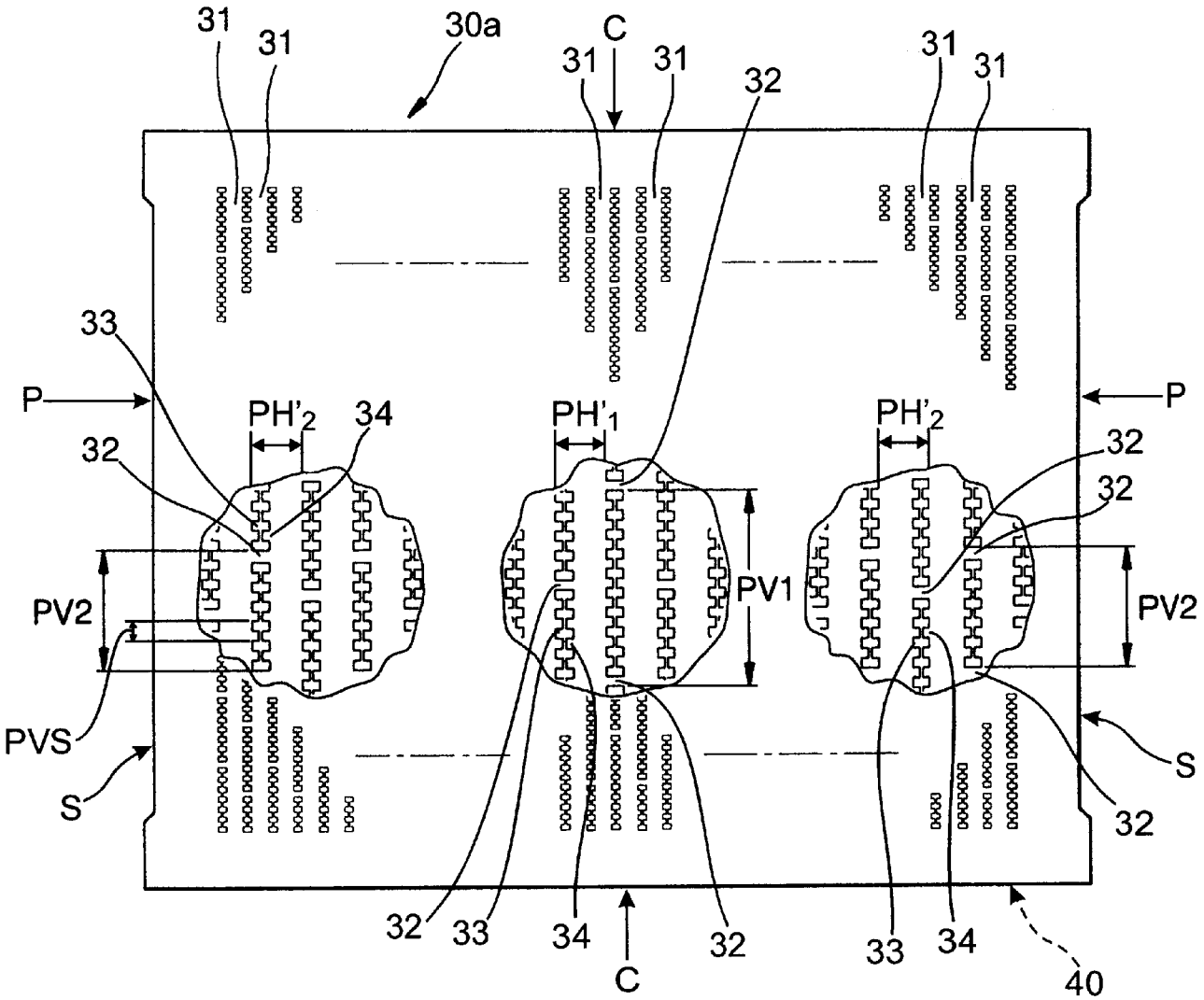
FIG. 5 is a plan view of a tension mask of a tension mask frame assembly for a color cathode ray tube according to another embodiment of the present invention, whereby the vertical pitch of a real bridge is smaller at both shorter sides of the tension mask than at the center portion of the tension mask.

Also, a tension mask frame assembly 100 according to another embodiment of the present invention is illustrated in FIG. 5. The tension mask frame assembly 100 of FIG. 5 includes a tension mask 30*a*. In the tension mask 30*a*, as to the vertical pitches PV1 and PV2 of the real bridges 32, which connect adjacent strips 31 of the tension mask 30*a* to each other, the vertical pitches PV2 at both shorter sides S of the tension mask 30*a* are smaller than the vertical pitch PV1 at the center portion C of the tension mask 30*a*, as shown in FIG. 5. In this embodiment of FIG. 5, it is natural that the number of real bridges 32, which respectively connect five (5) to nine (9) strips 31 to each other, for example, that are placed at the edge of both shorter sides S of the tension mask 30a, is greater in number than that of the real bridges 31 at the center portion C of the tension mask 30*a*.

Figure 6:
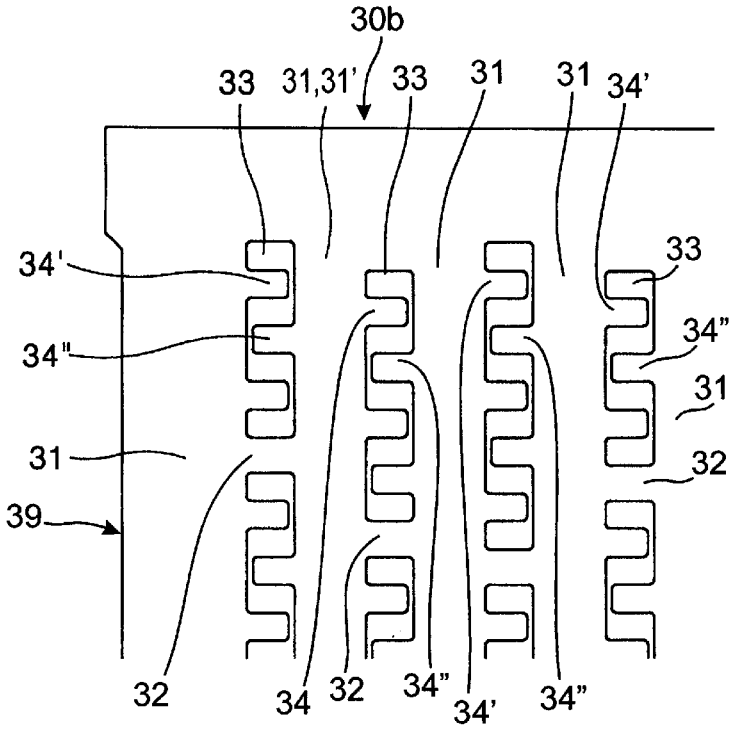
FIG. 6 is a plan view of another embodiment of a tension mask according to the present invention.
Figure 7:
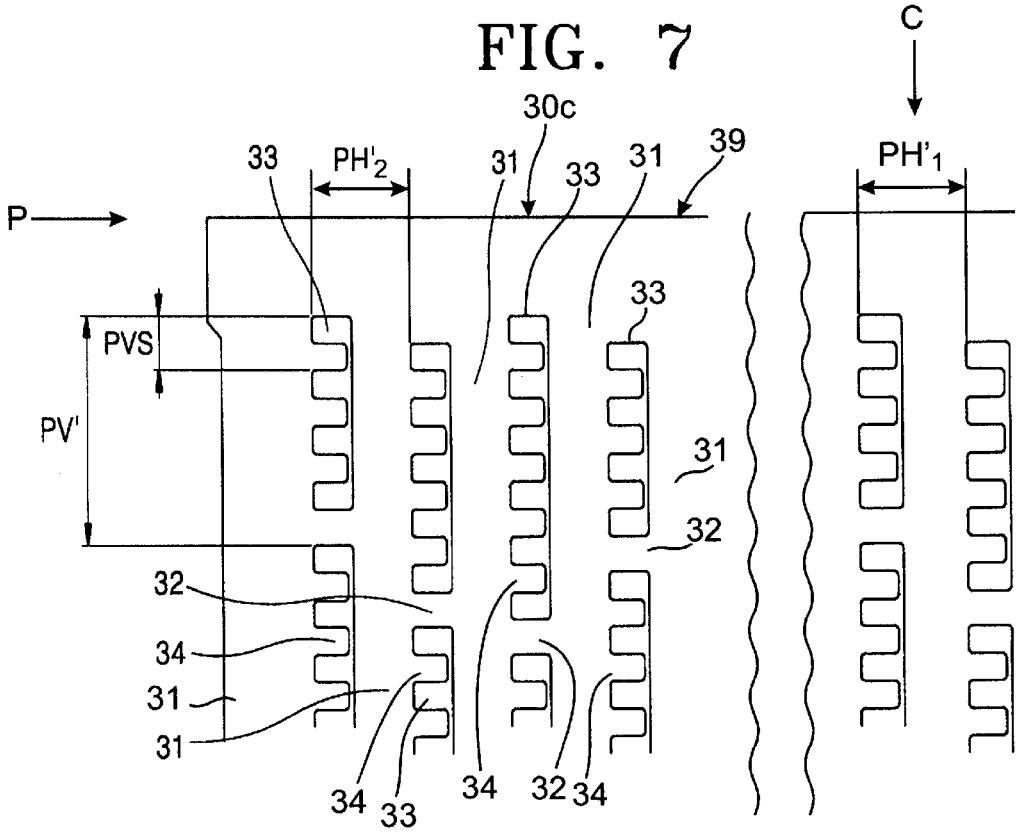
FIG. 7 is a plan view of a further embodiment of a tension mask according to the present invention.
Figure 8:
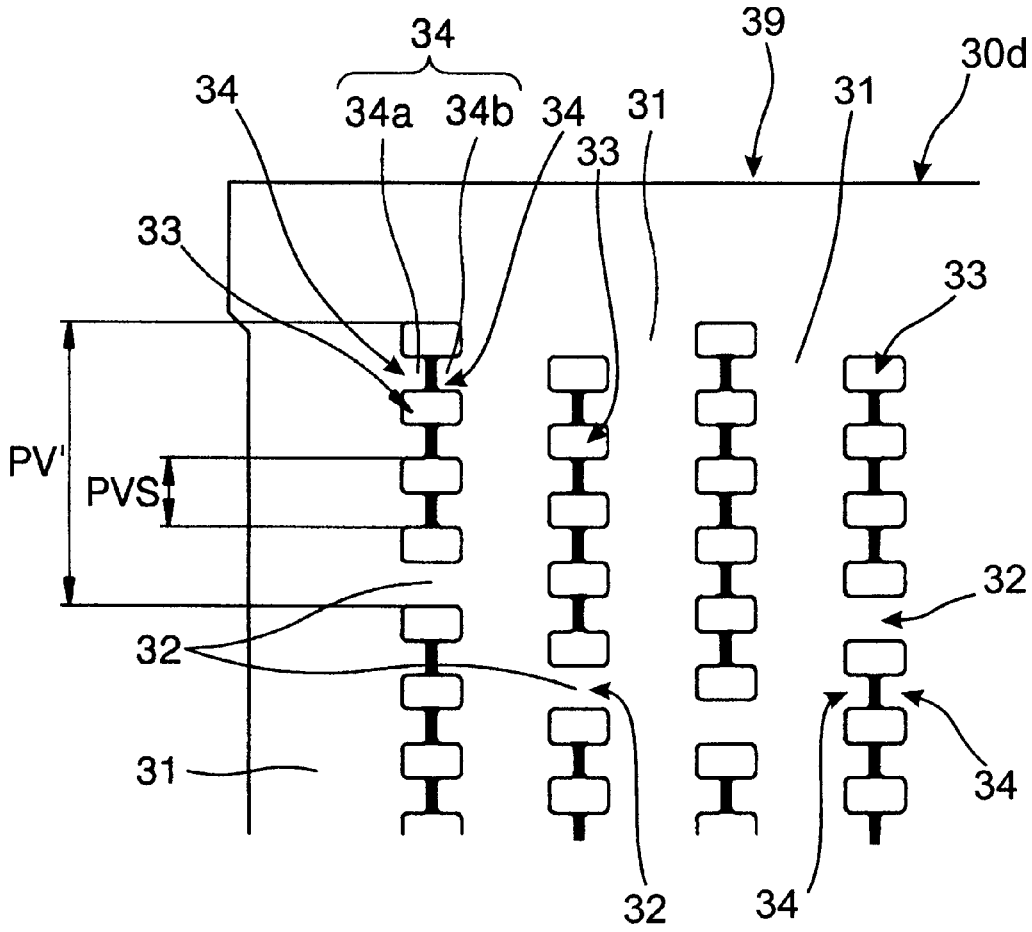
FIG. 8 is a plan view of another embodiment of a tension mask according to the present invention.

Further, FIGS. 6 through 8 illustrate other embodiments of a tension mask according to the present invention. FIG. 6 illustrates a tension mask 30*b* having a plurality of strips 31 on a thin plate 39, a plurality of real bridges 32 and a plurality of slots 33 as can be used in tension mask assembly 100 of FIG. 3. Also, FIG. 7 illustrates a further embodiment of a tension mask 30*c* having a plurality of strips 31 on a thin plate 39, a plurality of bridges 32 and a plurality of slots 33 as can be used in tension mask assembly 100 of FIG. 3. Also, FIG. 8 illustrates a further embodiment of a tension mask 30*d* having a plurality of strips 31 on a thin plate 39, and a plurality of real bridges 32 on a plurality of slots 33 as can be used in tension mask assembly 100 of FIG. 3.

Referring to FIGS. 4 through 8, dummy bridges 34, 34', 34" extending from a strip 31 on at least one side of a strip 31 are placed on a slot 33 defined by adjacent strips 31 and a corresponding real bridge 32 of the tension mask 30, 30*a*, 30*b*, 30*c*, 30*d*, and the slot 33 is partitioned by the dummy bridges 34 at intervals of a predetermined vertical pitch PVS. As shown in FIG. 4, for example, a dummy bridge 34 positioned at a slot 33 is made up of protrusions 34*a* and 34*b* extending in opposite directions from adjacent strips 31 on both sides of the corresponding slot 33. Alternatively, as shown in FIG. 6, a dummy bridge 34', is extended from a strip 31 on one side to an opposite strip side of an adjacent strip 31, 31', and an adjacent dummy bridge 34" is extended from the adjacent strip 30, 31' on the other side, such that the dummy bridges 34' and 34" alternate. Also, as shown in FIG. 7, dummy bridges 34 can extend from a strip 31 on one side to an opposite strip side of an adjacent strip 31 in a corresponding slot 33.

Further, in a case where the dummy bridges 34 are each made up of the protrusions 34*a* and 34*b* extending from strips 31 on both sides of a slot, it is preferable that the end of the protrusion 34*a* not contact the end of the protrusion 34*b*, such as illustrated in FIG. 4, for example.

In the tension masks 30, 30*a* through 30*d* described above, the vertical pitch PVS of a slot divided by the real bridge 32 and each of the corresponding dummy bridges 34, 34' and 34" is equal at the center portion C of the tension mask to that at the peripheral portion P thereof. However, undoubtedly, the vertical pitch PVS of a slot defined by the real bridge 32 and the dummy bridge 34, 34', 34" can become larger in the direction from the center portion C to the peripheral portion P in consideration of the deflection angle of an electron beam emitted from an electron gun. Also, the horizontal pitch PH' of the slots 33 formed by the strips 31 of the tension masks 30, 30*a* through 30*d* can be controlled according to an angle at which an electron beam is deflected by the deflection yoke. When considering the landing allowance of an electron beam, it is preferable that the horizontal pitch PH' of the slots 33 increases in a direction from the center C (horizontal pitch $PH'_1$) to the periphery P (horizontal pitch $PH'_2$) of the tension masks 30, 30*a* through 30*d*.

Referring again to FIG. 3, in the tension mask frame assembly 100, the frame 40 has a configuration to support the tension mask, such as tension masks 30, 30*a* through

30*d*, includes support members 41 and 42 for supporting the long or longer sides L of the tension mask, and elastic members 43 and 44 which connect the support members 41 and 42 to each other and have elastic forces. The support members 41 and 42 includes supporters 41*a* and 42*a* which are welded with the longer sides L of the tension mask 30, 30*a*, through 30*d*, respectively, and flanges 41*b* and 42*b* extending inwardly from the supporters 41*a* and 42*a*, respectively. However, a frame, such as frame 40, is not limited by the above embodiment such as illustrated in FIG. 3. Any kind of frame can be used as long as it does not diminish the effective screen when being mounted on a panel and can support a tension mask, such as tension masks 30, 30*a*, through 30*d*, in a state where a tensile force has been applied thereto.

The tension mask frame assembly, such as tension mask frame assembly 100, according to the present invention having a configuration as described above, is mounted on a color cathode ray tube, and can distinguish the colors of an electron beam emitted from an electron gun in order to allow the electron beam to accurately land on corresponding fluorescent materials. As for the tension masks 30, 30*a* through 30*d*, its longer sides L are supported by the support members 41 and 42 while its shorter sides S are not supported by the frame 40, so that the shorter sides S of the tension mask are more likely to be vibrated by an external impact than the longer sides.

However, in the tension masks according to the present invention, such as tension masks 30, 30*a* through 30*d*, the vertical pitch PV' of the real bridge 32, which connects the strips 31 to each other, becomes narrower in a direction from the center portion C to the peripheral portion P of the tension mask on the shorter sides S or is smaller at the peripheral portion P of both shorter sides S of the tension mask than at the center portion C of the tension mask, such that the ligament ratio gradually increases in a direction from the center portion C to the peripheral portion P of the tension mask 30, 30*a* through 30*d*. The stiffness of the tension mask 30, 30*a* through 30*d* also gradually increases from the center portion C to the peripheral portion P of the tension mask, such that even if a large impact is applied to the center portion C of the tension mask, this impact is gradually weakened while being transmitted in the horizontal direction of the tension mask, and finally disappears at an end strip portion existing at the horizontal edge of the tension mask. Thus, plastic deformation of the edge of the tension mask can be substantially prevented. Also, at the peripheral portion P of the tension mask, the vertical pitch PV' of the real bridge 32 connecting strips 31 to each other is narrow, such that the supporting force between the strips 31 is improved.

In the tension mask frame assembly such as tension mask frame assembly 100, for a color cathode ray tube according to the present invention having such configurations as described above, for example, the vertical pitch of a real bridge becomes narrower in the direction from the center portion to the peripheral portion of the tension mask, such that a supporting force against an external impact is increased, to promote preventing deformation of the tension mask. Also, the interval maintenance force of a real bridge between strips is improved against a tension applied in the directions of the shorter sides of the tension mask, so that contraction due to the tension applied to the tension mask can be reduced.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A tension mask frame assembly for a color cathode ray tube, comprising:

a tension mask formed on a plate, the tension mask including a plurality of strips and including a plurality of slots to separate by a predetermined distance corresponding adjacent ones of the plurality of strips;

a plurality of real bridges for respectively partitioning corresponding slots of the plurality of slots at a predetermined pitch interval by connecting adjacent ones of the plurality of strips; and a frame supporting the tension mask, a vertical pitch of the plurality of real bridges becomes smaller in a direction from a center portion of the tension mask to a peripheral portion of the tension mask, the vertical pitch of the plurality of real bridges is between real bridges partitioning the corresponding slot, the number of real bridges gradually increasing in the direction from the center portion to the peripheral portion of the tension mask.

2. The tension mask frame assembly for a color cathode ray tube according to claim 1, further comprised of the tension mask including a pair of opposing long sides and a pair of opposing shorter sides.

3. The tension mask frame assembly for a color cathode ray tube according to claim 1, further comprised of a horizontal pitch of the plurality of slots becoming larger in a direction from the center portion of the tension mask to the peripheral portion of the tension mask.

4. The tension mask frame assembly for a color cathode ray tube according to claim 1, further comprising:

a plurality of dummy bridges, each dummy bridge extending from a strip of the plurality of strips on at least one side of a corresponding slot of the plurality of slots in a direction towards a strip of the plurality of strips on an opposite side of the corresponding slot and being positioned at the corresponding slot that is partitioned by a corresponding one of the plurality of real bridges.

5. The tension mask frame assembly for a color cathode ray tube according to claim 4, further comprised of the tension mask including a pair of opposing long sides and a pair of opposing shorter sides.

6. The tension mask frame assembly for a color cathode ray tube according to claim 4, further comprised of a horizontal pitch of the plurality of slots becoming larger in a direction from the center portion of the tension mask to the peripheral portion of the tension mask.

7. The tension mask frame assembly for a color cathode ray tube according to claim 4, further comprised of each dummy bridge including a pair of protrusions, each pair of protrusions respectively extending from adjacent strips of the plurality of strips, whereby a corresponding pair of protrusions forming a dummy bridge are disposed in facing relation to each other.

8. The tension mask frame assembly for a color cathode ray tube according to claim 7, further comprised of the tension mask including a pair of opposing long sides and a pair of opposing shorter sides.

9. The tension mask frame assembly for a color cathode ray tube according to claim 7, further comprised of a horizontal pitch of the plurality of slots becoming larger in a direction from the center portion of the tension mask to the peripheral portion of the tension mask.

10. A tension mask frame assembly for a color cathode ray tube, comprising:

a tension mask formed on a plate, the tension mask including a pair of opposing long sides and a pair of opposing shorter sides, and the tension mask including a plurality of strips and including a plurality of slots to separate by a predetermined distance corresponding adjacent ones of the plurality of strips;

a plurality of real bridges respectively partitioning corresponding slots of the plurality of slots at a predetermined pitch interval by connecting adjacent ones of the plurality of strips; and a frame supporting the tension mask, a vertical pitch of the plurality of real bridges becomes smaller at both shorter sides of the tension mask than at a center portion of the tension mask, the vertical pitch of the plurality of real bridges is between real bridges partitioning the corresponding slot, the number of real bridges increasing in the direction from the center portion of the tension mask to both shorter sides of the tension mask.

11. The tension mask frame assembly for a color cathode ray tube according to claim 10, further comprised of a horizontal pitch of the plurality of slots becoming larger in a direction from the center portion of the tension mask to the shorter sides of the tension mask.

12. The tension mask frame assembly for a color cathode ray tube according to claim 10, further comprised of a horizontal pitch of the plurality of slots becoming larger in a direction from the center portion of the tension mask to a peripheral portion of the tension mask.

13. The tension mask frame assembly for a color cathode ray tube according to claim 10, further comprising:

a plurality of dummy bridges, each dummy bridge extending from a strip of the plurality of strips on at least one side of a corresponding slot of the plurality of slots in a direction towards a strip of the plurality of strips on an opposite side of the corresponding slot and being positioned at the corresponding slot that is partitioned by a corresponding one of the plurality of real bridges.

14. The tension mask frame assembly for a color cathode ray tube according to claim 13, further comprised of a horizontal pitch of the plurality of slots becoming larger in a direction from the center portion of the tension mask to the shorter sides of the tension mask.

15. The tension mask frame assembly for a color cathode ray tube according to claim 13, further comprised of a horizontal pitch of the plurality of slots becoming larger in a direction from the center portion of the tension mask to a peripheral portion of the tension mask.

16. The tension mask frame assembly for a color cathode ray tube according to claim 13, further comprised of each dummy bridge including a pair of protrusions, each pair of protrusions respectively extending from adjacent strips of the plurality of strips, whereby a corresponding pair of protrusions forming a dummy bridge are disposed in facing relation to each other.

17. The tension mask frame assembly for a color cathode ray tube according to claim 16, further comprised of a horizontal pitch of the plurality of slots becoming larger in a direction from the center portion of the tension mask to the shorter sides of the tension mask.

18. The tension mask frame assembly for a color cathode ray tube according to claim 16, further comprised of a horizontal pitch of the plurality of slots becoming larger in a direction from the center portion of the tension mask to a peripheral portion of the tension mask.

19. A tension mask for a color cathode ray tube, comprising:

a tension mask formed on a plate, the tension mask including a plurality of strips and including a plurality of slots to separate by a predetermined distance corresponding adjacent ones of the plurality of strips; and a plurality of real bridges respectively partitioning corresponding slots of the plurality of slots at a predetermined pitch interval by connecting adjacent ones of the plurality of strips, a vertical pitch of the plurality of real bridges becomes smaller in a direction from a center portion of the tension mask to a peripheral portion of the tension mask, the vertical pitch of the plurality of real bridges is between real bridges partitioning the corresponding slot, the number of real bridges gradually increasing in the direction from the center portion to the peripheral portion of the tension mask.

20. The tension mask for a color cathode ray tube according to claim 19, further comprising:

a plurality of dummy bridges, each dummy bridge extending from a strip of the plurality of strips on at least one side of a corresponding slot of the plurality of slots in a direction towards a strip of the plurality of strips on an opposite side of the corresponding slot and being positioned at the corresponding slot that is partitioned by a corresponding one of the plurality of real bridges.

21. The tension mask for a color cathode ray tube according to claim 20, further comprised of each dummy bridge including a pair of protrusions, each pair of protrusions respectively extending from adjacent strips of the plurality of strips, whereby a corresponding pair of protrusions forming a dummy bridge are disposed in facing relation to each other.

22. The tension mask for a color cathode ray tube according to claim 19, further comprised of the tension mask including a pair of opposing long sides and a pair of opposing shorter sides.

23. The tension mask for a color cathode ray tube according to claim 19, further comprised of a horizontal pitch of the plurality of slots becoming larger in a direction from the center portion of the tension mask to the peripheral portion of the tension mask.

24. A tension mask for a color cathode ray tube, comprising:

a tension mask formed on a plate, the tension mask including a pair of opposing long sides and a pair of opposing shorter sides, and the tension mask including a plurality of strips and including a plurality of slots to separate by a predetermined distance corresponding adjacent ones of the plurality of strips; and a plurality of real bridges respectively partitioning corresponding slots of the plurality of slots at a predetermined pitch interval by connecting adjacent ones of the plurality of strips, a vertical pitch of the plurality of real bridges becomes smaller at both shorter sides of the tension. mask than at a center portion of the tension mask, the vertical pitch of the plurality of real bridges is between real bridges partitioning the corresponding slot, the number of real bridges increasing in the direction from the center portion of the tension mask to both shorter sides of the tension mask.

25. The tension mask for a color cathode ray tube according to claim 24, further comprising:

a plurality of dummy bridges, each dummy bridge extending from a strip of the plurality of strips on at least one side of a corresponding slot of the plurality of slots in a direction towards a strip of the plurality of strips on an opposite side of the corresponding slot and being positioned at the corresponding slot that is partitioned by a corresponding one of the plurality of real bridges.

26. The tension mask for a color cathode ray tube according to claim 25, further comprised of each dummy bridge including a pair of protrusions, each pair of protrusions respectively extending from adjacent strips of the plurality of strips, whereby a corresponding pair of protrusions forming a dummy bridge are disposed in facing relation to each other.

27. The tension mask for a color cathode ray tube according to claim 24, further comprised of a horizontal pitch of the plurality of slots becoming larger in a direction from the center portion of the tension mask to the shorter sides of the tension mask.

28. The tension mask for a color cathode ray tube according to claim 24, further comprised of a horizontal pitch of the plurality of slots increasing in a direction from the center portion of the tension mask to a peripheral portion of the tension mask.

* * * * *